US007631755B1

(12) United States Patent
Sanders

(10) Patent No.: US 7,631,755 B1
(45) Date of Patent: Dec. 15, 2009

(54) ACCESSORY GOLF BAG STAND AND ACCESSORY BAG

(76) Inventor: Cindy Sanders, 16750 Gulf Blvd., Unit 712, North Redington Beach, FL (US) 33708

( * ) Notice: Subject to any disclaimer, the term of this patent is extended or adjusted under 35 U.S.C. 154(b) by 710 days.

(21) Appl. No.: 11/450,173

(22) Filed: Jun. 12, 2006

(51) Int. Cl.
*A63B 55/00* (2006.01)

(52) U.S. Cl. ..... 206/315.7; 248/96

(58) Field of Classification Search ..... 206/315.7; 248/96

See application file for complete search history.

(56) References Cited

U.S. PATENT DOCUMENTS 2,453,565 A * 11/1948 Barden ..... 248/96
2,661,175 A 12/1953 Holder
3,570,795 A * 3/1971 Benzel ..... 248/96
3,593,766 A * 7/1971 Harmon et al. ..... 206/315.7
3,666,221 A * 5/1972 Schilz ..... 248/96
D335,994 S * 6/1993 Cude, Jr. ..... D6/552
D372,126 S 7/1996 Martinez

* cited by examiner

*Primary Examiner*—Tri M Mai
(74) *Attorney, Agent, or Firm*—Thomas Frost

(57) ABSTRACT

An accessory golf bag stand is provided having a central rod with a pair of L-shaped anchors. The rod and the anchors are sharpened for embedding into the ground. A hook portion at an upper end of the rod provides means for carrying the stand and mounting on a mobile cart. A circular ring is attached to the rod. A golf bag can be attached to the central rod and ring. An optional detachable base member is provided to support the lower end of the golf bag.

4 Claims, 4 Drawing Sheets

ACCESSORY GOLF BAG STAND AND ACCESSORY BAG

BACKGROUND OF INVENTION

The present invention relates to a golf bag stand having a central rod and two L-shaped anchors for insertion into the ground, along with an attachable golf bag. An upper ring along with a detachable base support member is provided for the bag. A hook portion at the upper end of the central rod provides means for either carrying the attached bag or connecting to a mobile golf cart.

Currently many golf bag stands have either a single spike for insertion into the ground, or if an additional spike is present, only one anchor besides the central spike is provided. For example, U.S. Pat. No. 2,661,175, discloses a bag stand having an L-shaped member at the lower end of the stand, as does U.S. Pat. No. Des. 372,126. The disadvantage of these stands is that when a golf bag is attached to the stands in an upright position, wind or porous ground leads to instability. The three prong approach of the current invention provides for greater stability for the bag in an upright position because a triangular base is created.

It is an object of the invention to provide a stand and accessory bag which are easy to carry and transport, yet provide stability not found in present stands.

It is a further object to allow golf bags of various sizes and shapes to be attached to the stand, and by having a base member giving further support to convenience bags.

SUMMARY OF THE INVENTION

The general purpose of the present invention, which will be described subsequently in greater detail, is to provide a new and improved golf bag stand and attachable golf bag.

To attain this, the present invention comprises a golf bag stand having a central rod and two L-shaped anchor members attached near the lower end of the central rod. The rod and anchor members are sharpened for insertion into the ground. A generally hook shaped portion is integrally formed at the top portion of the rod, the portion allowing for easy transport and connection to a motorized golf cart. An upper ring is also attached juxtaposed the top portion of the rod, opposite the hook portion.

A detachable base is fitted near the lower end of the rod. A golf bag, having attachment means such as snaps, VELCRO or ties along the bag's upper end and side, is supported by a base member at the lower end of the bag and connected to the stand at the upper ring and the rod.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
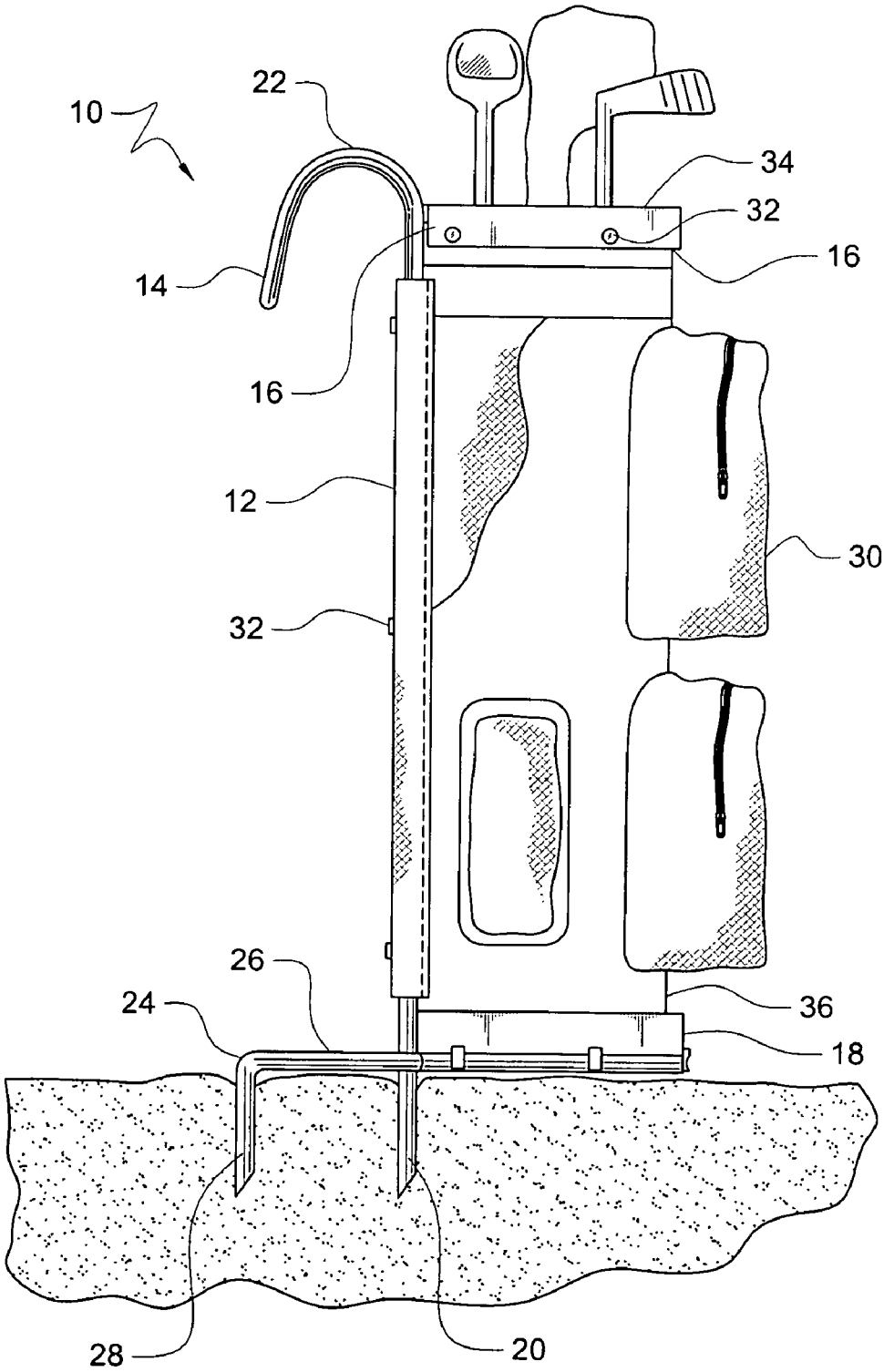
FIG. 1 is a side elevation view of the present invention with a golf bag attached to the stand, and the L-shaped anchors embedded into the ground.
Figure 2:
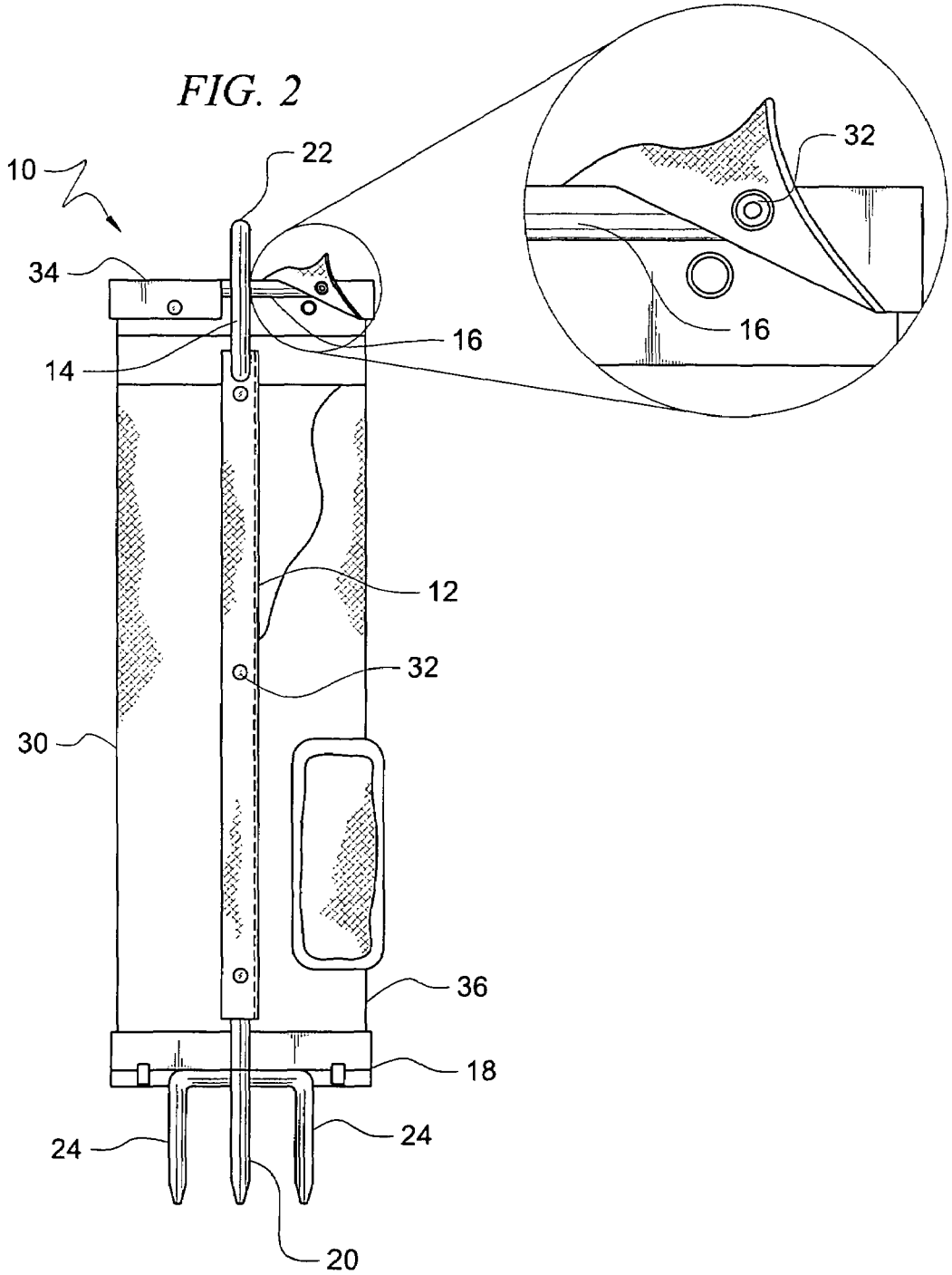
FIG. 2 is a front view of the present invention showing the L-shaped anchors at approximately 30 degrees apart.
Figure 3:
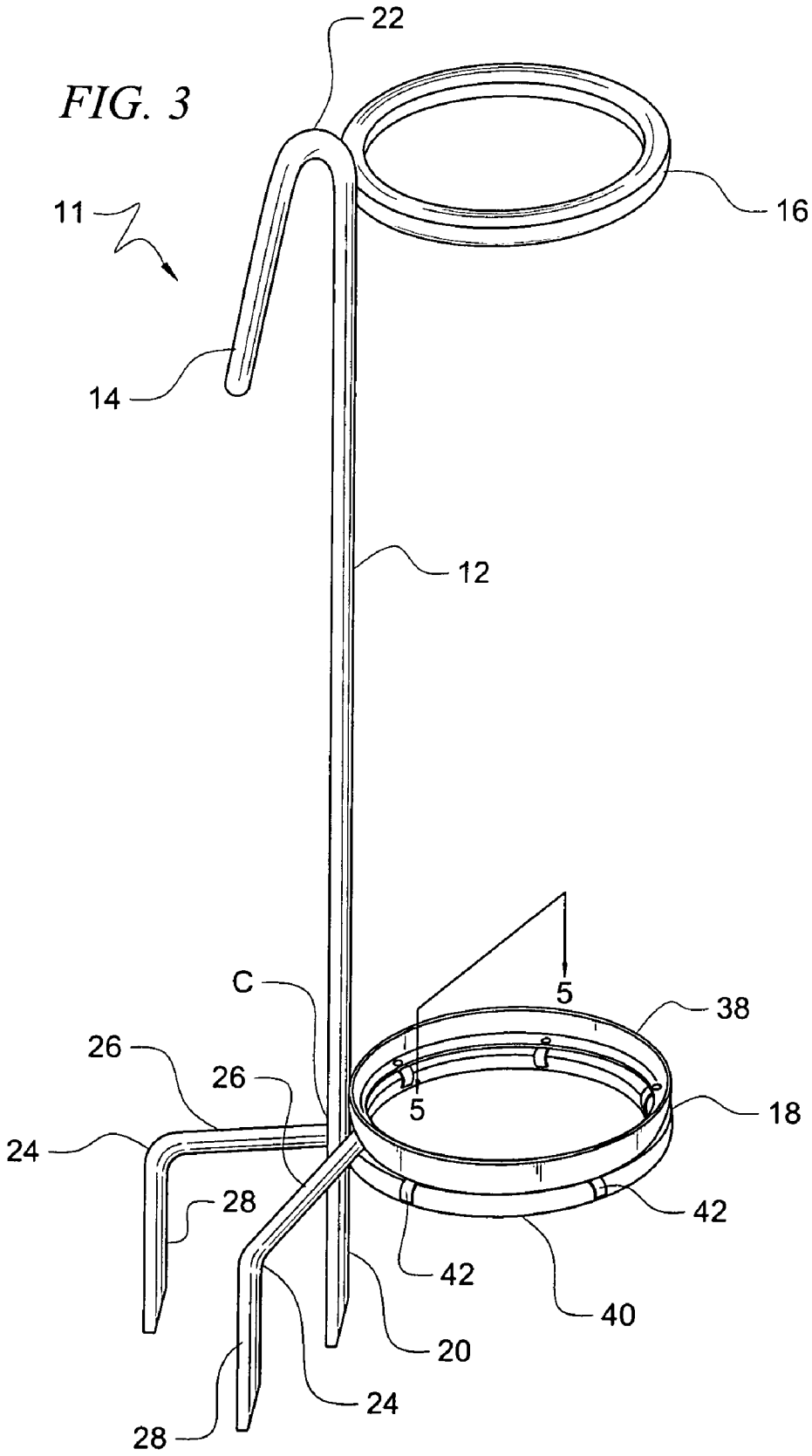
FIG. 3 is a perspective view of the invention with the golf bag removed and the base member attached.
Figure 4:
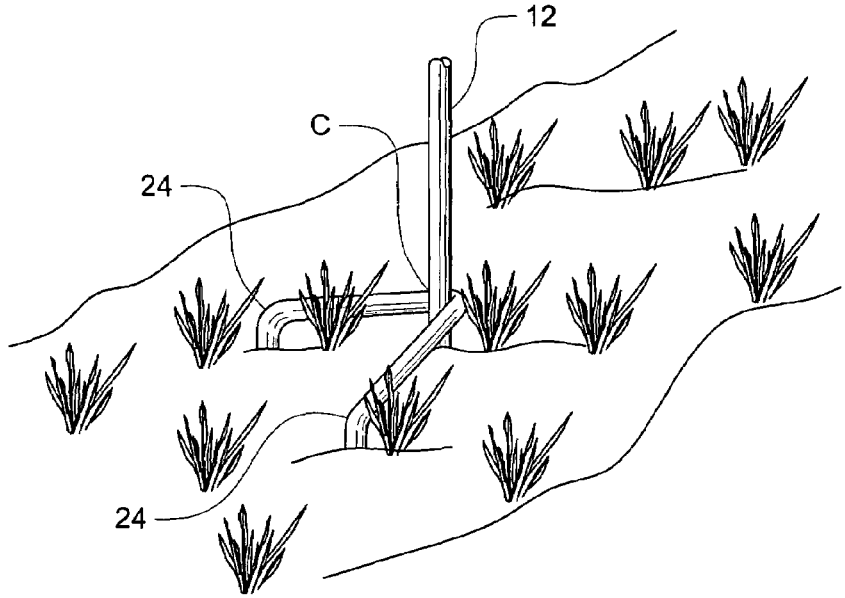
FIG. 4 is a fragmentary view of the L-shaped anchors and central rod embedded in the ground.

Turning to FIGS. 1-3, an embodiment of the present invention 10 will now be described in greater detail. A golf bag stand 11 comprising a central rod 12 has an upper end 22 and a lower end 20, with a downwardly depending hook shaped portion 14 integrally formed at the upper end 22. A generally circular ring 16 is attached, as by welding, to the upper end 22 of the central rod 12 opposite the hook shaped portion 14. A pair of L-shaped anchors 24 is integrally attached to a point vertically upward from the lower end 20 of the central rod 12. The L-shaped anchors 24 include a substantially horizontal first end 26 which is attached to the central rod 12, as by welding. A substantially vertical second end 28 is located on the same plane as the lower end 20 of the central rod 12. The second end 28 of the L-shaped anchors 24 and the lower end 20 of the central rod 12 are sharpened for penetrating the ground. The L-shaped anchors 24 are preferably attached to the central rod 12 at approximately 30 degrees separation to provide the greatest stability.

The central rod 12, ring 16, and L-shaped anchors 24 are preferably made of stainless steel, although a variety of materials which can counter bending stresses may be used.

A golf bag 30, of generally tubular construction, being open at a first end 34 and closed at a second end 36, is provided to be connected by bag attachment means 32 to the ring 16 and the central rod 12. Although the bag 30 shown in the drawings is of a circular construction, with accompanying pockets for golf balls and the like, bags of other construction are possible for use with the ring 16 and central rod 12. The attachment means 32 are positioned vertically along the outer surface of the bag 30 to connect to the central rod 12, and, as shown in FIG. 2, circumferentially around the outer surface of the bag 30 near the first end 34. In the preferred embodiment the attachment means 32 are snaps, and material of the bag 30 with the attachment means 32 is folded back over the ring 16 and the central rod 12 to connect. While the attachment means 32 as shown are snaps, other means for securing of the bag 30, such as VELCRO and ties could be used.

Figure 5:
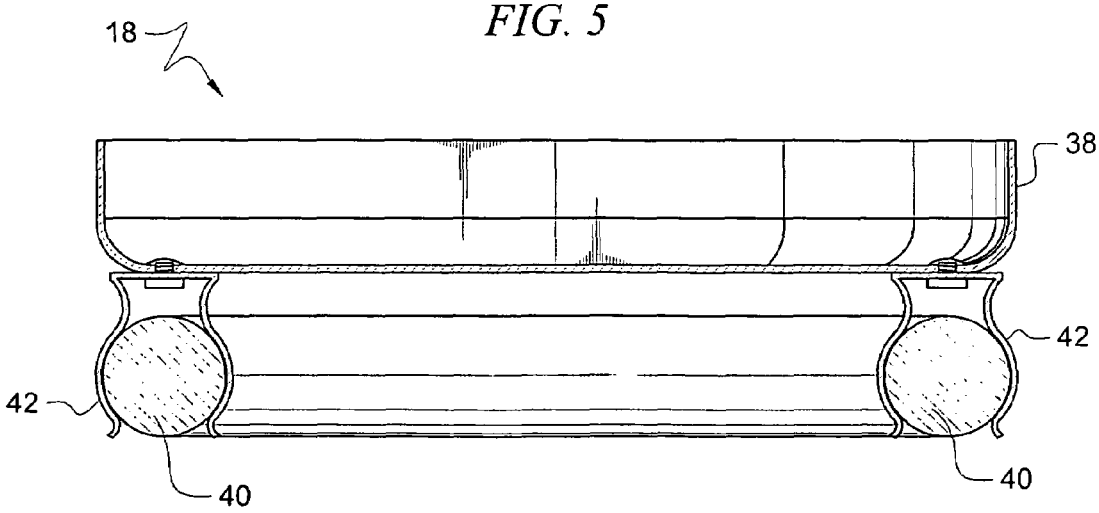
FIG. 5 is a cross sectional view of the base member of FIG. 3 taken at line 5-5 of FIG. 3.

A detachable base member 18 is adapted to be connected near the lower end 20 of the central rod 14. The base member 18, being relatively circular, provides support for the second end 36 of the golf bag 30, and can be connected relatively along the same horizontal plane where the L-shaped anchors 24 attach to the central rod 12. The preferred embodiment of the base member, as illustrated in FIGS. 3 and 5, comprises a circular frame 38 mounted on a lower ring 40 via snap rings 42. When not in use the base member 18 can be disconnected from the stand 11. The stand 11 can operated with or without the base member 18, depending upon the type of bag 30 used. A bag 30 with a rigid lower end 20 would not need the support of the base member 18.

In use, the second end 36 of the golf bag 30 is placed into the base member 18, and the bag 30 is connected to the ring 16 and the central rod 12 by the attachment means 32. The golf bag stand and bag 10, with golf clubs in the bag 30, can be carried to a practice area, placed on a mobile golf cart, or when a minimal amount of clubs are needed removed from the cart and taken to the green of a particular hole.

The stand 11 is embedded into the ground by grasping the central rod 12, and by use of a foot, pushing the first end 26 of the L-shaped anchors 24 downward. While other lengths are possible, the second ends 28 of the L-shaped anchors 24 are preferably approximately 3½ inches in length. The sharpened ends of the central rod 12 and second ends 28 of the L-shaped anchors 24 allow the stand 11 to penetrate into the ground to a distance equal to the length of the second ends 28 of the L-shaped anchors 24.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

I claim:

1. An accessory golf bag stand and accessory bag, comprising in combination:

a central rod having an upper end and a lower end, the lower end being sharpened for penetrating the ground;

a downwardly depending hook portion, the downwardly depending hook portion extending from the upper end of the central rod;

a circular ring attached to the upper end of the central rod;

a pair of L-shaped anchors, each anchor having a substantially horizontal first end and a substantially vertical second end, being integrally attached to the central rod at the first end, and the second end of each anchor being sharpened for penetrating the ground;

a golf bag having a first upper end and a second lower end, and having attachment means to connect to the central rod and the circular ring; and a detachable base member comprised of a circular frame integrally formed with snap rings mounted to a lower ring with the snap rings, the base member adapted to be secured to the central rod substantially near the lower end of the central rod, and being positioned to provide support for the lower end of the golf bag.

2. The accessory golf bag stand and accessory bag of claim 1, wherein the attachment means of the golf bag are snaps.

3. An accessory golf bag stand, comprising in combination:

a central rod having an upper end and a lower end, the lower end being sharpened for penetrating the ground;

a downwardly depending hook portion, the downwardly depending hook portion extending from the upper end of the central rod;

a circular ring attached to the upper end of the central rod;

a pair of L-shaped anchors, each anchor having a substantially horizontal first end and a substantially vertical second end, being integrally attached to the central rod at the first end, and the second end of each anchor being sharpened for penetrating the ground; and a detachable base member comprised of a circular frame integrally formed with snap rings mounted to a lower ring with the snap rings, the base member adapted to be secured to the central rod substantially near the lower end of the central rod, and being positioned to provide support for a lower end of a golf bag.

4. An accessory golf bag stand, comprising in combination:

a central rod having an upper end and a lower end, the lower end being sharpened for penetrating the ground;

a downwardly depending hook portion, the downwardly depending hook portion extending from the upper end of the central rod;

a circular ring attached to the upper end of the central rod; and a pair of L-shaped anchors, each anchor having a substantially horizontal first end and a substantially vertical second end, being integrally attached to the central rod at the first end, and the second end of each anchor being sharpened for penetrating the ground, wherein the pair of L-shaped anchors is attached to the central rod so that the first ends and the second ends of the L-shaped anchors are at approximately 30 degrees separation.

* * * * *